US005653177A

United States Patent [19]

Rimbaud et al.

[11] Patent Number: 5,653,177

[45] Date of Patent: Aug. 5, 1997

[54] BOGIE FRAME

[75] Inventors: Michel Rimbaud; Frédéric Liodenot, both of Le Breuil, France

[73] Assignee: GEC Alsthom Transport SA, Paris, France

[21] Appl. No.: 435,785

[22] Filed: May 5, 1995

[30] Foreign Application Priority Data

May 30, 1994 [FR] France ..... 94 06535

[51] Int. Cl.[6] ..... B61F 3/00

[52] U.S. Cl. ..... 105/182.1

[58] Field of Search ..... 105/157.1, 182.1, 105/206.2, 206.1; 52/731.6, 731.1, 731.2

[56] References Cited

U.S. PATENT DOCUMENTS

| | | | |
|---|---|---|---|
| 3,313,245 | 4/1967 | Sundby | 105/197 |
| 3,596,571 | 8/1971 | Hill | 92/222 |
| 3,984,125 | 10/1976 | Paton | 280/716 |
| 4,937,946 | 7/1990 | Steinhoff | 33/410 |
| 5,062,369 | 11/1991 | Cobden | 105/396 |
| 5,249,530 | 10/1993 | Wike | 105/168 |
| 5,303,657 | 4/1994 | Oda | 105/206.1 |

FOREIGN PATENT DOCUMENTS

| | | |
|---|---|---|
| 0345709A1 | 12/1989 | European Pat. Off. . |
| 0434642A3 | 6/1991 | European Pat. Off. . |
| 515140 | 12/1971 | Switzerland . |

*Primary Examiner*—Robert J. Oberleitner
*Assistant Examiner*—C. T. Bartz
*Attorney, Agent, or Firm*—Sughrue, Mion, Zinn, Macpeak & Seas

[57] ABSTRACT

A bogie frame constituted by first and second sole-bars, first, second, third, and fourth half-cross-members, first and second auxiliary sole-bars, first and second brake supports, first and second drive fastenings, and first and second shock absorber supports, wherein:

said elements are one-piece elements; and said one-piece elements are made of a material containing, for the most part, an aluminum alloy.

8 Claims, 1 Drawing Sheet

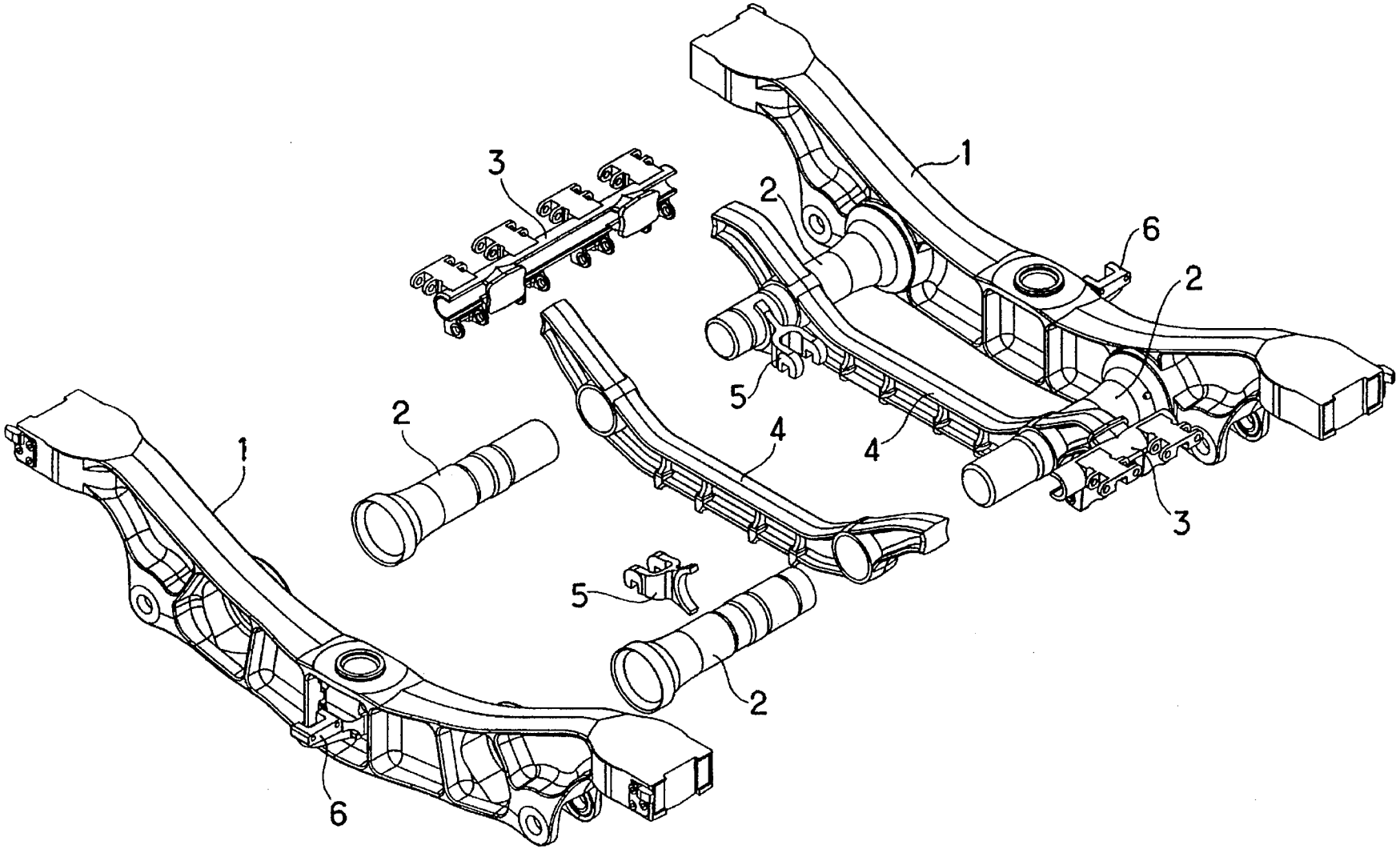
1
2
3
4
5
6

BOGIE FRAME

The present invention relates to bogie frames in general, and more particularly it relates to a bogie frame made of aluminum alloy.

BACKGROUND OF THE INVENTION

As mentioned in the article "L'allégement des châssis de bogies mécano-soudés des TGV" [Reducing the weight of all-welded bogie frames for TGVs], published in "La Revue Générale des Chemins de Fer", November 1992, pages 17 to 23, by the publishing house Gautier-Villars, a bogie performs a certain number of major functions by means of members that are designed and dimensioned for that purpose.

These functions are, in particular:

- a guidance function, associated with the wheels and the axles;
- a braking function, associated with brake cylinders and disks;
- a traction function, associated with motor-and-gear-box units and with motor axles;
- a comfort function, associated with primary and secondary suspensions.

The art of a frame designer is to provide an architectural choice that achieves a suitable compromise between all of the various requirements taken into consideration, namely: resistance to fatigue; available space; mass; manufacturing costs.

State of the art bogie frames are mainly made of all-welded construction on the basis of A42 FP type steel sheet, as specified in French standard NF A 36-205.

The steel sheet is cut, shot-blasted, dressed, folded, and prepared for being assembled together by welding so as to form box-shaped subassemblies which, in a final assembly operation, are built up to constitute the final frame.

In addition to requiring a manufacturing cycle that is lengthy due to assembling together a large number of pieces of metal sheet, amounting to about 100 unit-pieces, the manufacture of the frame requires welding to be thoroughly mastered with respect both to performance and inspection.

From that article, and also from prior art bogies, it can be seen that studies on how to make bogie frames have been directed essentially to using steel, and in particular sheet steel.

OBJECTS AND SUMMARY OF THE INVENTION

Thus, the Applicant has the merit of proposing a bogie frame that makes use of materials that have not yet been used in the structure of bogie frames and that goes against the prejudices of the person skilled in the art.

Another merit of the Applicant is to propose a bogie frame enabling manufacture to be simplified.

Another merit of the Applicant is to propose a bogie frame made up of elements made of cast or forged aluminum alloy.

Thus, an object of the invention is to provide a bogie frame enabling the number of components parts to be reduced.

Another object of the invention is to provide a bogie frame enabling the number of welded joints to be reduced.

Another object of the invention is to provide a bogie frame enabling manufacturing time to be reduced.

Another object of the invention is to provide a bogie frame enabling the number of different parts to be reduced by taking advantage of symmetry.

Another object of the invention is to provide a bogie frame enabling all of the functions of prior art frames to be retained.

Another object of the invention is to provide a bogie frame enabling the overall mass of the bogie to be retained or even reduced.

According to the invention, the bogie frame includes at least one part, wherein said part is made of a material that contains, for the most part, an aluminum alloy.

According to the invention, the bogie frame is made up of elements wherein:

- said elements are one-piece elements; and
- said one-piece elements are made of a material containing, for the most part, an aluminum alloy.

The invention also provides a bogie frame satisfying at least one of the following characteristics:

- the aluminum alloy parts or elements are forged or cast and/or machined; and
- the aluminum alloy parts or elements are welded, screwed, glued, and/or riveted together.

In accordance with the invention, the bogie frame is constituted by first and second sole-bars 1, first, second, third, and fourth half-cross-members 2, first and second auxiliary sole-bars 4, first and second brake supports 3, first and second drive fastenings 5, and first and second shock absorber supports 6, wherein:

- said elements 1 to 6 are one-piece elements; and
- said one-piece elements 1 to 6 are made of a material containing, for the most part, an aluminum alloy.

The invention also provides a bogie frame satisfying at least one of the following characteristics:

- some of the parts or of said one-piece elements 1 to 6 are obtained by a forging method and the others by a casting method;
- the one-piece elements obtained by a forging method are the one-piece elements that are subjected to the greatest stresses, and the one-piece elements obtained by a casting method are the one-piece elements of complex shape and subjected to smaller stresses; and
- the one-piece elements obtained by a forging method are obtained by a stamping method or by an extrusion method.

An advantage of the bogie frame of the invention is a considerable reduction in the number and volume of welded connections because there are no sheets welded edge-to-edge.

Another advantage of the bogie frame of the invention is a reduction in assembly time.

Another advantage of the bogie frame of the invention is simplified stock management for its component parts.

Another advantage of the bogie frame of the invention is its use of assembly methods that are reliable.

BRIEF DESCRIPTION OF THE DRAWING

Other objects, characteristics, and advantages of the invention appear on reading the following description of the preferred embodiment of a bogie frame given below with reference to the accompanying drawing, in which:

- the sole FIGURE is an exploded view of a bogie frame of the invention.

MORE DETAILED DESCRIPTION

According to an essential characteristic of the invention, the bogie frame is made up in particular of parts or elements made of aluminum alloy or containing, for the most part, an aluminum alloy.

According to another essential characteristic of the invention, the elements are one-piece elements.

Preferably, the parts or elements made of aluminum alloy are forged or cast and/or machined.

Preferably, the parts or elements made of aluminum alloy are welded, screwed, glued, and/or riveted together.

In other words, the methods of welding, screwing, gluing, and/or riveting can be used on their own or in combination to fix together the parts or elements of the bogie frame.

The exploded view of the sole FIGURE shows the preferred embodiment of a bogie frame of the invention.

The bogie frame shown in the sole FIGURE comprises first and second sole-bars 1, first, second, third, and fourth half-cross-members 2, first and second auxiliary sole-bars 4, first and second brake supports 3, first and second drive fastenings 5, and first and second shock absorber supports 6.

The frame comprises a main frame constituted by the first and second main sole-bars 1 which are interconnected by two groups, each comprising two half- cross-members 2.

The two auxiliary sole-bars are contained within the main frame and their ends receive the two brake supports 3.

The two fastenings 5 are fixed on the two half-cross-members 2 and serve to receive the drive device for the bogie.

The two shock absorber supports 6 are screwed or welded to the main sole-bars 1 and they receive anti-hunting shock absorbers (not shown) as are known in the state of the art.

A solution integrated in the main sole-bars 1 would also be possible.

The one-piece elements making up the bogie frame of the invention are preferably made in application of two different methods.

A first method, forging, is used for the structural elements of the bogie frame that are subjected to the greatest stresses.

As mentioned above, these elements are made of aluminum alloy or of a material that contains, for the most part, an aluminum alloy.

Depending on the shape of the element, a stamping or extrusion method is used.

The preferred grade of metal is 6082 of French standard NF A 50-901, and heat treatment T6 of French standard NF A 02-150.

A second method, casting, is used for elements that are complex in shape and are subjected to smaller stresses.

It is preferable to use metal of grade AS7G06 from French standard NF A 57-702.

Table 1 below shows the preferred method of obtaining the various different components of the bogie frame, and it gives the number of each of the components required per frame.

In addition, Table 1 specifies whether the elements of the bogie frame are symmetrical.

TABLE 1

| Element | No. per frame | Method of manufacture | Is there symmetry? |
|---|---|---|---|
| main sole-bar 1 | 2 | stamping | yes |
| half-cross-member 2 | 4 | extrusion, forging | yes |

TABLE 1-continued

| Element | No. per frame | Method of manufacture | Is there symmetry? |
|---|---|---|---|
| auxiliary sole-bar 4 | 2 | stamping, casting | yes |
| brake support 3 | 2 | casting, stamping | yes |
| drive fastening 5 | 2 | stamping, molding | yes |
| shock absorber support 6 | 2 | stamping, molding | no |

From Table 1 it can be seen that there are fourteen main elements.

The main sole-bars 1 receive the primary and secondary suspension assemblies (not shown) that are known in the state of the art.

The main sole-bars 1 serve to ensure cohesion of the bogie against external stresses.

The main sole-bars 1 receive the anti-hunting shock absorber supports 6.

Finally, the main sole-bars 1 receive the primary suspension abutment/hoisting hook (not shown) known in the state of the art.

The half-cross-members 2 support the fastenings 5 for the drive device (not shown) known in the state of the art.

The auxiliary sole-plates 4 serve to fix the anti-roll bar elements (not shown) known in the state of the art.

The brake supports 3 receive the disk brake rigging (not shown) known in the state of the art.

The drive fastenings 5 receive drive connecting rods that extend between the bodywork and the bogie (not shown) and known in the state of the art.

The shock absorber supports 6 receive the shock absorbers between the bodywork and the bogie (not shown) that are known in the state of the art.

Following Table 2 gives the preferred type of connection between the main elements of the bogie frame and also the number of connections per bogie frame.

TABLE 2

| Connection | Type of connection | No. of connections |
|---|---|---|
| main sole-bar 1 to half-cross-member 2 | welded | 4 |
| half-cross-member 2 to half-cross-member 2 | welded | 2 |
| half-cross-member 2 to auxiliary sole-bar 4 | welded | 8 |
| auxiliary sole-bar 4 to brake support 3 | welded | 4 |
| main sole-bar 1 to shock absorber support 6 | mechanical | 4 |

From Table 2 it can be seen that the bogie frame of the invention can be assembled with no more than eighteen welds.

It can be seen from the description that some of the one-piece parts or elements making up the bogie frame of the invention are obtained by forging while the others are obtained by a casting method.

The one-piece elements obtained by a forging method are the one-piece elements subjected to the greatest stress levels and the one-piece elements obtained by a casting method are the one-piece elements of complex shape that are subjected to smaller stresses.

The one-piece elements obtained by a forging method are obtained by stamping or by extrusion.

We claim:

1. A bogie frame, comprising:

a plurality of parts, wherein said parts are made of a material that contains, for the most part, an aluminum alloy, some of said aluminum alloy parts are forged aluminum alloy parts, and other of said aluminum alloy parts are cast aluminum alloy parts; and a weld, screw, glue and rivet which couples said aluminum alloy parts to each other.

2. A bogie frame as claimed in claim 1, wherein some of said aluminum alloy parts are machined aluminum alloy parts.

3. A bogie frame, comprising:

one-piece elements, said one-piece elements are made of a material containing, for the most part, an aluminum alloy, some of said aluminum alloy one-piece elements are forged aluminum alloy one-piece elements, and other of said aluminum alloy one-piece elements are cast aluminum alloy one-piece elements; and a weld, screw, glue and rivet which couples said aluminum alloy one-piece elements to each other.

4. A bogie frame according to claim 3, wherein at least some of said aluminum alloy elements are molded aluminum alloy elements and machined aluminum alloy elements.

5. A bogie frame, comprising the following elements:

first and second sole-bars;

first, second, third, and fourth half-cross members;

first and second auxiliary sole-bars;

first and second brake supports;

first and second drive fastenings; and first and second shock absorber supports; wherein:

said elements are one-piece elements;

said one-piece elements are made of a material containing, for the most part, an aluminum alloy; and some of said one-piece elements are forged one-piece elements and other of said one-piece elements are cast one-piece elements.

6. A bogie frame according to claim 5, wherein the forged one-piece elements obtained are the one-piece elements that are subjected to the greatest stresses, and the cast one-piece elements are the one-piece elements of complex shape and subjected to smaller stresses.

7. A bogie frame according to claim 6, wherein the forged one-piece elements are one of stamped one-piece elements and extruded one-piece elements.

8. A bogie frame according to claim 5, further comprising a weld, screw, glue and rivet which couples said aluminum alloy one-piece elements to each other.

* * * * *